US009183787B2

(12) United States Patent
Botzas et al.

(10) Patent No.: US 9,183,787 B2
(45) Date of Patent: Nov. 10, 2015

(54) DEVICES AND METHODS FOR PROCESSING IMAGE DATA

(75) Inventors: Anthony Botzas, San Jose, CA (US); MoonHwan Im, Cupertino, CA (US); Sarah Sunyoung Hwang, Sunnyvale, CA (US); Candice Hellen Brown Elliott, Santa Rosa, CA (US)

(73) Assignee: SAMSUNG DISPLAY CO., LTD. (KR)

( * ) Notice: Subject to any disclaimer, the term of this patent is extended or adjusted under 35 U.S.C. 154(b) by 563 days.

(21) Appl. No.: 13/485,717

(22) Filed: May 31, 2012

(65) Prior Publication Data

US 2013/0321476 A1 Dec. 5, 2013

(51) Int. Cl.
*G09G 3/34* (2006.01)
*G09G 3/36* (2006.01)

(52) U.S. Cl.
CPC ..... *G09G 3/3406* (2013.01); *G09G 3/3611* (2013.01); *G09G 2300/0452* (2013.01); *G09G 2320/0646* (2013.01); *G09G 2330/021* (2013.01); *G09G 2340/16* (2013.01); *G09G 2360/16* (2013.01)

(58) Field of Classification Search
CPC . G09G 3/3406; G09G 3/3413; G09G 3/3611; G09G 5/10; G09G 2300/0452; G09G 2320/0233; G09G 2320/0242; G09G 2320/0271; G09G 2320/0276; G09G 2320/06; G09G 2320/0626–2320/0653; G09G 2330/021; G09G 2340/16
USPC ..... 345/690–697, 87–104
See application file for complete search history.

(56) References Cited

U.S. PATENT DOCUMENTS

| | | | | |
|---|---|---|---|---|
| 5,751,261 | A * | 5/1998 | Zavracky et al. | 345/55 |
| 2007/0216636 | A1* | 9/2007 | Lo | 345/102 |
| 2007/0279372 | A1* | 12/2007 | Brown Elliott et al. | 345/102 |
| 2008/0074372 | A1* | 3/2008 | Baba et al. | 345/89 |
| 2011/0012824 | A1* | 1/2011 | Nonaka et al. | 345/102 |

* cited by examiner

*Primary Examiner* — Nathan Danielsen
(74) *Attorney, Agent, or Firm* — Innovation Counsel LLP

(57) ABSTRACT

A module processes image data to provide gray level signals to be used for displaying an image. The module may include a scale value control member for determining a first scale value. The module may further include a brightness control member for determining a controlled brightness value using a requested brightness value, a brightness control parameter, and a baseline brightness value. The module may further include a modification member for determining a modified scale value using the first scale value and the controlled brightness value. The module may further include a scaler for generating the gray level signals using the image data and at least one of the modified scale value and a damped scale value, the damped scale value being determined using the modified scale value. The module may further include hardware circuitry for implementing at least one of the aforementioned components.

20 Claims, 2 Drawing Sheets

DEVICES AND METHODS FOR PROCESSING IMAGE DATA

BACKGROUND OF THE INVENTION

The present invention is related to devices and methods for processing image data. More particularly, the present invention is related to devices and methods for processing image data in order to reduce undesirable contrast effects in displayed images, wherein in the image data may include red, green, blue, and/or white image data.

Liquid crystal display devices have been widely used in televisions, computer monitors, and mobile devices. Conventional RGB liquid crystal display devices may include red, green, and blue color elements for combining the three primary colors in various ways to present various colors in displayed images. For enhancing brightness of displayed images and/or for saving energy consumed by backlight modules of display devices, RGBW liquid crystal display devices that further include white color elements (e.g., pixels or subpixels having no color filters) have been implemented.

In RGBW devices, the white color elements may substantially enhance the brightness of white components and desaturated-color components in displayed images. Nevertheless, the brightness enhancement effect of the white color elements may substantially diminish for image components having colors exceeding 50% saturation, and the white color elements may have substantially no brightness enhancement effect on image components having pure 100% saturated colors, such as red, green, and blue. The disparity of the brightness enhancement effect may lead to undesirable contrast effects when saturated colors arc viewed in a displayed image simultaneously with peak white or desaturated colors that have received the effective brightness enhancing benefit of the white color elements. Saturated colors, especially "warm" colors such as yellow, orange, and red, may appear especially dark when displayed in an image having a very bright (e.g., white) reference.

SUMMARY

An embodiment of the present invention may be related to a processing module for processing image data to provide a set of gray level signals to be used by a liquid crystal display module for displaying an image. The processing module may include a scale value control member configured to determine a first scale value. The processing module may further include a brightness control member configured to determine a controlled brightness value using a requested brightness value, a brightness control parameter, and a baseline brightness value. The processing module may further include a modification member configured to determine a modified scale value using the first scale value and the controlled brightness value. The modified scale value may pertain to a current frame, which may represent an image element to be displayed within a current time period of a preset length. The processing module may further include a scaler configured to generate the set of gray level signals using the image data and at least one of the modified scale value and a damped scale value, wherein the damped scale value may be determined using at least the modified scale value. The processing module may further include hardware circuitry configured to implement at least one of the scale value control member, the brightness control member, the modification member, and the scaler.

The above summary relates to only one of the many embodiments of the invention disclosed herein and is not intended to limit the scope of the invention, which is set forth in the claims herein. These and other features of the present invention will be described in more detail below in the detailed description of the invention and in conjunction with the following figures.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION

Figure 1:
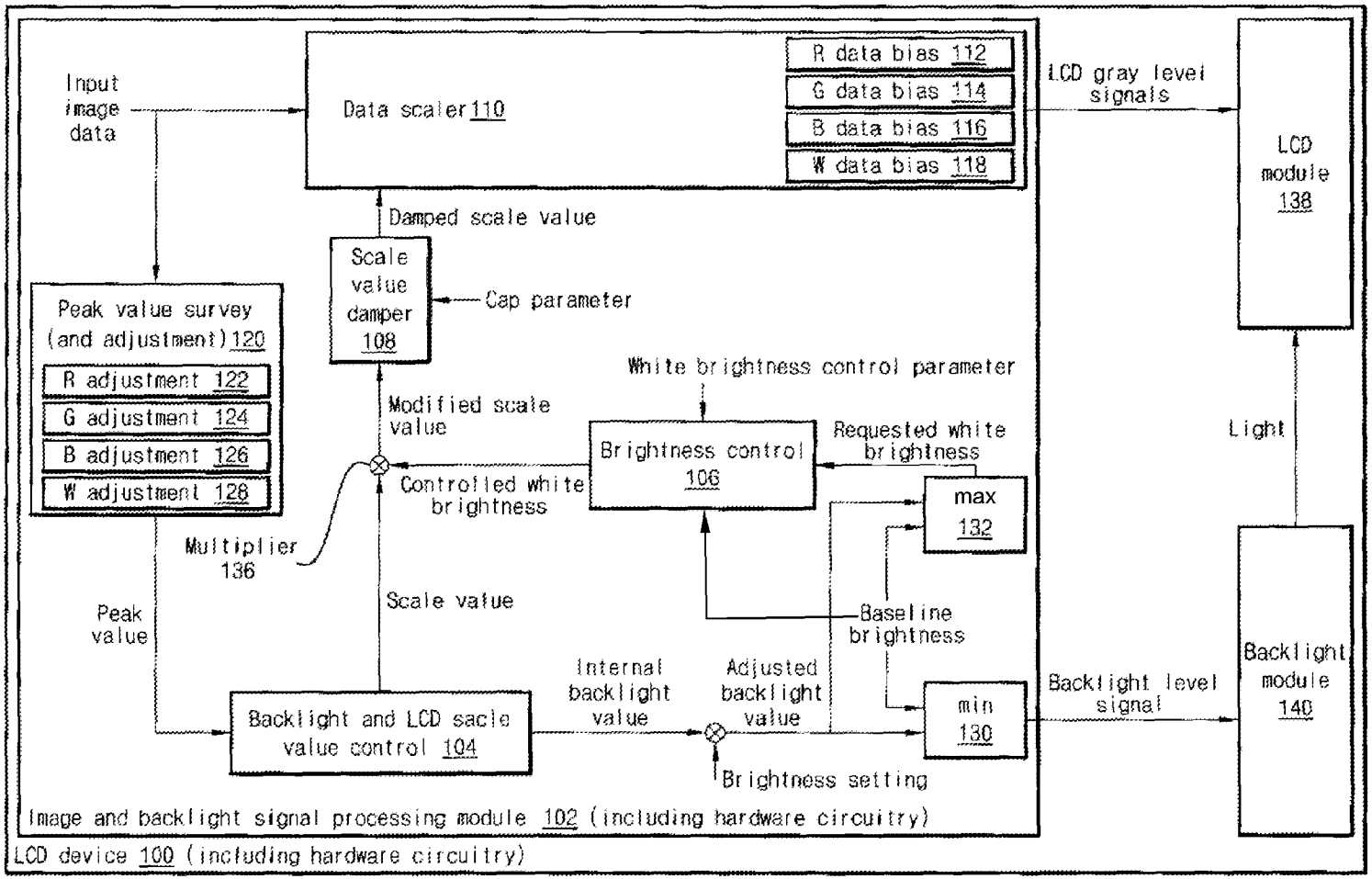
FIG. 1 shows a schematic block diagram illustrating a liquid crystal display device in accordance with one or more embodiments of the present invention, the liquid crystal display device including a processing module for processing image data in accordance with one or more embodiments of the invention.

The present invention will now be described in detail with reference to a few embodiments thereof as illustrated in the accompanying drawings. In the following description, numerous specific details are set forth in order to provide thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

Various embodiments are described herein below, including methods and techniques. It should be kept in mind that the invention might also cover an article of manufacture that includes a non-transitory computer readable medium on which computer-readable instructions for carrying out embodiments of the inventive technique are stored. The computer readable medium may include, for example, semiconductor, magnetic, opto-magnetic, optical, or other forms of computer readable medium for storing computer readable code. Further, the invention may also cover apparatuses for practicing embodiments of the invention. Such apparatus may include circuits, dedicated and/or programmable, to carry out operations pertaining to embodiments of the invention. Examples of such apparatus include a general purpose computer and/or a dedicated computing device when appropriately programmed and may include a combination of a computer/computing device and dedicated/programmable hardware circuits (such as electrical, mechanical, and/or optical circuits) adapted for the various operations pertaining to embodiments of the invention.

One or more embodiments of the present invention may be related to a processing module for processing image data to provide a set of gray level signals to be used by a liquid crystal display module for displaying an image. The processing module may include a scale value control member configured to determine a first scale value. The processing module may further include a brightness control member configured to determine a controlled brightness value using a requested brightness value, a brightness control parameter, and a baseline brightness value. The processing module may further include a modification member configured to determine a modified scale value using the first scale value and the controlled brightness value. The modified scale value may pertain to a current frame, which may be an image element to be displayed within a current time period having a preset length. The processing module may further include a scaler configured to generate the set of gray level signals using the image data and at least one of the modified scale value and a damped scale value, wherein the damped scale value may be determined using at least the modified scale value.

In one or more embodiments, the processing module may further include a scale value damper configured to determine the damped scale value using the modified scale value, a previous-frame modified scale value that pertains to a previous frame, and a cap parameter. The previous frame may represent an image element displayed within a previous time period having the preset length. The previous time period may immediately precede the current time period associated with the current frame or may precede the current time period with at least an intervening time period between the previous time period and the current time time period.

In one or more embodiments, the processing module may further include an adjustment member configured to determine an adjusted backlight value using an internal backlight value and a brightness setting value. The requested brightness value is determined using the adjusted backlight value and the baseline brightness value. The adjustment member may be a multiplier.

In one or more embodiments, the processing module may further include a survey member configured to determine a peak value based on a maximum value pertaining to the image data in the previous frame. The first scale value and the internal backlight value may be determined using the peak value. The survey member may be further configured to determine the peak value according to a color associated with the maximum value.

In one or more embodiments, the brightness control member may be configured for multiplying a difference between the requested brightness value and the baseline brightness value by the brightness control parameter to produce a first product. In one or more embodiments, the brightness control member may be further configured for adding the first product to the baseline brightness value to produce a first calculated brightness value.

In one or more embodiments, the brightness control member may be configured for providing the first calculated brightness value as the controlled brightness value.

In one or more embodiments, the brightness control member may be configured for doubling the internal backlight value (which is determined using the peak value) to produce a doubled internal backlight value. The brightness control member may be further configured for subtracting the doubled internal backlight value from 2 to produce a first adjustment coefficient. The brightness control member may be further configured for subtracting the baseline brightness value from the doubled internal backlight value to produce a second adjustment coefficient. The brightness control member may be further configured for determining the controlled brightness value using the first adjustment coefficient, the requested brightness value, and the first calculated brightness value.

In one or more embodiments, the brightness control member may be configured for calculating the controlled brightness value by adding a product of the second adjustment coefficient and the first calculated brightness value to a product of the first adjustment coefficient and the requested brightness value.

In one or more embodiments, the brightness control member may be configured for subtracting a product of a third adjustment coefficient and the first adjustment coefficient from I to produce a fourth adjustment coefficient. The brightness control member may be further configured for calculating the controlled brightness value by adding a product of the fourth adjustment coefficient and the first calculated brightness value to a product of the third adjustment coefficient, the first adjustment coefficient, and the requested brightness value.

In one or more embodiments, the scaler may be configured to generate the set of gray level signals further using a set of hue-dependent bias factors.

In one or more embodiments, the processing module may include one or more hardware circuits configured to perform one or more tasks associated one or more of the aforementioned components, such as the scale value control member, the brightness control member, the modification member, the scaler, the adjustment member, the modification member, the survey member, the scale value damper, etc.

One or more embodiments of the present invention may be related to a liquid crystal display device that includes an aforementioned processing module. The liquid crystal display device may further include a backlight module configured to provide light according to a backlight level signal that is determined using the baseline brightness value and the adjusted backlight value. The liquid crystal display device may further include a liquid crystal display module configured to display an image using the set of gray level signals and the light. The liquid crystal display device may include one or more hardware circuits configured to perform one or more tasks related to at least one of the processing module, the backlight module, and the liquid crystal display module.

One or more embodiments of the present invention may be related to a method for processing image data to provide a set of gray level signals to be used by a liquid crystal display module for displaying an image. The method may be implemented using hardware circuitry. The method may include determining a first scale value using the hardware circuitry. The method may further include determining a controlled brightness value using a requested brightness value, a brightness control parameter, a baseline brightness value, and the hardware circuitry. The method may further include determining a modified scale value using the first scale value, the controlled brightness value, and the hardware circuitry. The modified scale value may pertain to a current frame, which may represent an image clement to be displayed within a current time period having a preset length. The method may further include generating the set of gray level signals using the image data, at least one of the modified scale value and a damped scale value, and the hardware circuitry, wherein the damped scale value may be determined using at least the modified scale value.

In one or more embodiments, the method may further include determining the damped scale value using the modified scale value, a previous-frame modified scale value that pertains to a previous frame, and a cap parameter.

In one or more embodiments, the method may further include determining an adjusted backlight value using an internal backlight value and a brightness setting value. The method may further include determining the requested brightness value using the adjusted backlight value and the baseline brightness value.

In one or more embodiments, the method may further include determining a peak value based on a maximum value pertaining to the image data in the current frame. The method may further include determining the first scale value and the internal backlight value using the peak value.

In one or more embodiments, the method may further include determining the peak value according to a color associated with the maximum value.

In one or more embodiments, the method may further include multiplying a difference between the requested brightness value and the baseline brightness value by the brightness control parameter to produce a first product. The method may further include adding the first product to the baseline brightness value to produce a first calculated brightness value.

In one or more embodiments, the method may include providing the first calculated brightness value as the controlled brightness value.

In one or more embodiments, the method may include doubling the internal backlight value to produce a doubled internal backlight value. The method may further include subtracting the doubled internal backlight value from 2 to produce a first adjustment coefficient. The method may further include subtracting the baseline brightness value from the doubled internal backlight value to produce a second adjustment coefficient. The method may further include determining the controlled brightness value using the first adjustment coefficient, the requested brightness value, and the first calculated brightness value.

According to one or more embodiments of the invention, brightness of image data may be properly scaled down when at least a saturated color and a least a desaturated color coexist in an image to be displayed, and brightness of image data may be substantially maintained or maximized when an image to be displayed includes one or more of desaturated colors but no saturated colors or includes one or more saturated colors but no desaturated colors. Advantageously, embodiments of the invention may provide the benefits of energy saving and/or brightness enhancement of RGBW devices while minimizing the undesirable simultaneous contrast effects that may be common in conventional RGBW devices.

According to one or more embodiments of the invention, brightness adjustment may be performed according to the hues of saturated colors in an image to be displayed. For example, if red and white coexist in the image, the brightness may be scaled down more, while if blue and white coexist in the image, the brightness may be scaled down less or may not be scaled down. Advantageously, unnecessary brightness reduction may be avoided or minimized, and substantially consistent and desirable user experience may be provided.

The features and advantages of the present invention may be better understood with reference to the figures and discussions that follow.

FIG. 1 shows a schematic block diagram illustrating a liquid crystal display device 100 (or LCD display device 100) in accordance with one or more embodiments of the present invention. The liquid crystal display device 100 may include an image and backlight signal processing module 102 (or processing module 102) for processing image data to provide a set of gray level signals in accordance with one or more embodiments of the invention. The liquid crystal display device 100 may further include a backlight module 140 configured to provide light according to a backlight level signal that may be determined by the processing module 102 using a baseline brightness value (which is a maximum or 100% drive value for the backlight module 140) and an adjusted backlight value (which is to be further discussed below). The liquid crystal display device 100 may further include a liquid crystal display module 138 (or LCD module 138) configured to display an image using the set of gray level signals and the light. The liquid crystal display device 100 may include one or more hardware circuits configured to perform one or more tasks pertaining to at least one of the processing module 102, the backlight module 140, and the liquid crystal display module 138.

The processing module 102 may include one or more of a peak value survey (and adjustment) member 120 (or survey member 120), a backlight and liquid crystal display scale value control member 104 (or scale value control member 104), a brightness control member 106, a modification member 136 (which may be a multiplier), a scale value damper 108, a data scaler 110, an adjustment member 134 (which may be a multiplier), a minimum value determination member 130, a maximum value determination member 132, and one or more hardware circuits (such as a field-programmable gate array or components of a field-programmable gate array) configured for performing one or more tasks associated with one or more members of the processing module 102. The features and advantages of the liquid crystal display device 100, the processing module 102, and the associated members arc further discussed with reference to FIG. 2.

Figure 2:
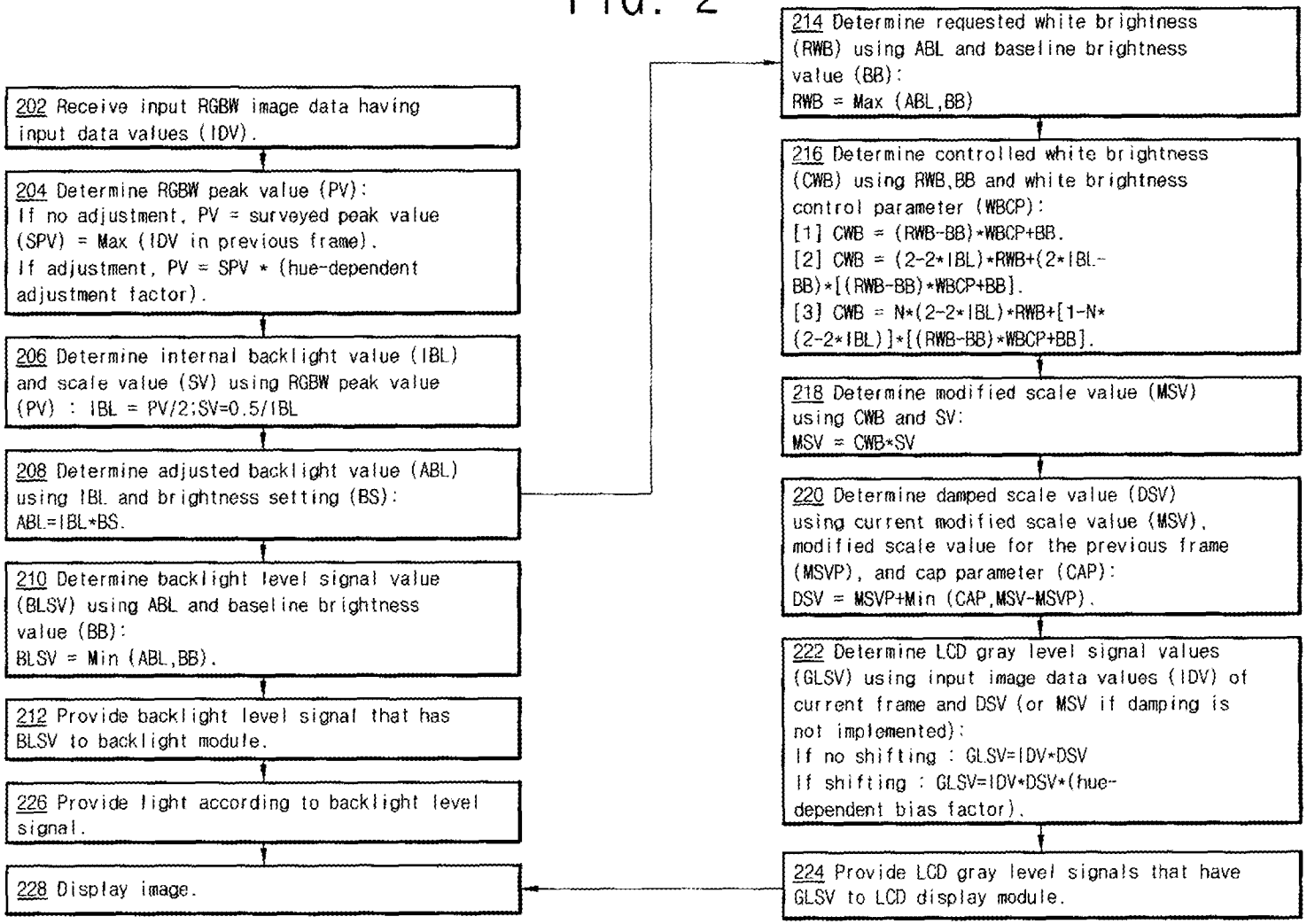
FIG. 2 shows a flowchart illustrating a method for processing image data in accordance with one or more embodiments of the present invention.

FIG. 2 shows a flowchart illustrating a method for processing image data in accordance with one or more embodiments of the present invention. The method may be implemented using hardware circuitry associated with the liquid crystal display device 100, the processing module 102, and/or one or more of the members included in the processing module 102 illustrated in the example of FIG. 1.

In step 202, the processing module 102 (and/or the data scaler 110) may receive input RGBW image data having input image data values (IDV).

In step 204, the processing module 102 (and/or the survey member 120) may survey the input RGBW image data and may determine a RGBW peak value (PV) based on a maximum value pertaining to the input RGBW image data in a previous frame. The previous frame may be, for example, a frame (an image clement displayed) immediately preceding the current frame or a frame preceding the current frame with at least one intervening frame.

The processing module 102 (and/or the survey member 120) may determine a surveyed peak value (SPV), wherein the SPV is the maximum value of the input image data values (IDV) in the previous frame, i.e., SPV=Max(IDV in the previous frame).

Given that the maximum data value in a frame generally cannot be determined until the frame ends, processing module 102 (and/or the survey member 120) may survey data values in a previous frame, instead of data values in the current frame. In general, the brightness for the image data may not dramatically change during two consecutive frames and/or frames sufficiently close to each other. Therefore, the maximum data value in the previous frame may desirably represent the maximum data value of the current frame.

As a first example, if the previous frame includes both a red (R) component and a white (W) component, the image data for the previous frame may include (200%, 0, 0, 0) for the R component, corresponding to (512, 0, 0, 0) in an 8-bit system, for example, and (100%, 100%, 100%, 100%) for the W component, corresponding to (255, 255, 255, 255) in an 8-bit system, for example. Accordingly, the surveyed peak value (SPV) may be 200%, coming from the R component.

As a second example, if the previous frame includes both a blue (B) component and a white (W) component, the image data for the previous frame may include (0, 0, 200%, 0) for the B component and (100%, 100%, 100%, 100%) for the W component. Accordingly, the surveyed peak value (SPV) may be 200%, coming from the B component.

As a third example, if the previous frame includes a white (W) component, represented by (100%, 100%, 100%, 100%) without including saturated-color components, the surveyed peak value (SPV) may be 100%, corning from the W component.

In one or more embodiments, the processing module 102 (and/or the survey member 120) may output the survey peak value (SPV) as the RGBW peak value (PV).

In one or more embodiments, the processing module 102 (and/or the survey member 120) may determine the RGBW peak value (PV) further according to the color associated with the maximum value of the previous frame. For example, the processing module 102 (and/or the survey member 120) may determine the RGBW peak value (PV) according to the formula:

PV=SPV*(hue-dependent adjustment factor), wherein if the SPV comes from a red (R) component, then a R-associated adjustment factor 122 may be used for the hue-dependent adjustment factor; if the SPV comes from a green (G) component, then a G-associated adjustment factor 124 may be used for the hue-dependent adjustment factor; if the SPV comes from a blue (B) component, then a B-associated adjustment factor 126 may be used for the hue-dependent adjustment factor; if the SPV comes from a white (W) component, then a W-associated adjustment factor 128 may be used for the hue-dependent adjustment factor.

The processing module 102 (and/or the survey member 120) may store a set of hue-dependent adjustment factors that includes one or more of the R-associated adjustment factor 122, the G-associated adjustment factor 124, the B-associated adjustment factor 126, and the W-associated adjustment factor 128, which may be, for example, 1, 0.5, 0.5, and 1, respectively. Additionally or alternatively, the set of hue-dependent adjustment factors may include one or more adjustment factors associated with one or more other colors.

In the first example (R and W coexist), given that the SPV comes from a red component, PV=200%*I=200%.

In the second example (B and W coexist), given that the SPV comes from a blue component, PV=200%*0.5=100%. In one or more embodiments, the B-associated adjustment factor 126 may be 0.75 instead of 0.5: accordingly, PV=200%*0.75=150%, a value between the PV in the first example and the PV in the third example (calculated as follows).

In the third example (W without RGB), given that the SPV comes from a white component, PV=100%*1=100%.

By introducing the hue-dependent adjustment factor, embodiments of the invention may advantageously minimize image brightness reduction or avoid unnecessarily image brightness reduction when there are no substantial or conspicuous undesirable contrast effects, such as when a blue component and a white component coexist in an image.

In step 206, the processing module 102 (and/or the scale value control member 104) may determine an internal backlight value (IBL) and a scale value (SV) using the RGBW peak value (PV) according to, for example, the formulas:

IBL=PV/2;

SV=0.5/IBL.

The factors 2 and 0.5 are implemented in the formulas in the processing module 102 because an RGBW system may substantially double the peak values of R, G, and B components of an RGB system.

In the first example (R and W coexist), IBL=200%/2=100%, and SV=0.5/100%=0.5=50%.

In the second example (B and W coexist), if PV is not adjusted, IBL=200%/2=100%, and SV=0.5/100%=0.5=50%, wherein the IBL and SV values being equal to those in the first example (R and W coexist); if PV is adjusted using the adjustment factor 0.5, IBL=100%/2=50%, and SV=0.5/50%=1=100%, the IBL and SV values being equal to those in the third example (W without RGB) calculated as follows.

In the third example (W without RGB), IBL=100%/2=50%, and SV=0.5/50%=1=100%.

In step 208, the processing module 102 (and/or the adjustment member 134 or multiplier 134) may determine an adjusted backlight value (ABL) using the IBL and an brightness setting (BS) according to, for example, the formula:

ABL=IBL*BS, wherein the BS may be a factory default setting value or a value that is set according to user input received by the LCD device 100 through a user interface. For example, if the LCD device 100 is used outdoors, the BS may be set higher such that displayed images may be clearly viewable under the sunlight. As an example, BS may be 200%.

In the first example (R and W coexist), ABL=100%*200%=200%.

In the second example (B and W coexist), if PV is not adjusted, ABL=100%*200%=200%, the ABL being equal to that in the first example (R and W coexist); if PV is adjusted using the adjustment factor 0.5, ABL=50%*200%=100%, the ABL being equal to that in the third example (W without RGB) calculated as follows.

In the third example (W without RGB), ABL=50%*200%=100%.

In step 210, the processing module 102 (and/or the minimum value determination member 130) may determine a backlight level signal value (BLSV) using the ABL and a baseline brightness value (BB) according to, for example, the formula:

BLSV=Min(ABL, BB).

The BB may be a maximum or 100% drive value for the backlight module 140, which may correspond to 2^8−1=255 if the LCD device 100 is an 8 bit system, for example. The BLSV should not exceed the BB.

In the first example (R and W coexist), BLSV=Min(200%, 100%)=100%.

In the second example (B and W coexist), if PV is not adjusted, BLSV=Min(200%, 100%)=100%, the BLSV being equal to that in the first example (R and W coexist); if PV is adjusted using the adjustment factor 0.5, BLSV=Min(100%, 100%)=100%, the BLSV being equal to that in the third example (W without RGB) calculated as follows.

In the third example (W without RGB), BLSV=Min(100%, 100%)=100%.

In one or more embodiments, the third example may have a BLSV that is different from the BLSV of the first example.

In step 212, the processing module 102 (and/or the minimum value determination member 130) may provide a backlight level signal that has the BLSV to the backlight module 140. In the first example (R and W coexist), BLSV=100%. In the second example (B and W coexist), if PV is not adjusted, BLSV=100%; if PV is adjusted using the adjustment factor 0.5, BLSV=100%, the BLSV being equal to that in the third example (W without RGB) calculated as follows. In the third example (W without RGB), BLSV=100%.

In step 226, the backlight module 140 may provide light to the LCD module 138 according to the backlight level signal.

In step 214, the processing module 102 (and/or the maximum value determination member 132) may determine a requested white brightness (RWB) using the ABL and the BB according to, for example, the formula:

RWB=Max(ABL, BB).

In the first example (R and W coexist), RWB=Max(200%, 100%)=200%.

In the second example (B and W coexist), if PV is not adjusted, RWB=Max(200%, 100%)=200%, the RWB being equal to that in the first example (R and W coexist); if PV is adjusted using the adjustment factor 0.5, RWB=Max(100%, 100%)=100%, the RWB being equal to that in the third example (W without RGB) calculated as follows.

In the third example (W without RGB), RWB=Max(100%, 100%)=100%.

In step 216, the processing module 102 (and/or the brightness control member 106) may determine a controlled white brightness (CWB) using the RWB, the BB, and a white brightness control parameter (WBCP). The WBCP may be user-configurable and may be set according to user preferences or aggressiveness in adjusting brightness to reduce undesirable simultaneous. For example, WBCP may be in a range of 0 to 100%. As an example, WBCP=50%.

In one or more embodiments, the processing module 102 (and/or the brightness control member 106) may determine the CWB according to the following linear formula:

CWB=(RWB−BB)*WBCP+BB=(first product)+BB=(first calculated brightness value).

The formula may enable a straightforward implementation of the processing module 102 by implementing a substantial linear relation between CWB and WBCP.

In the first example (R and W coexist), CWB=(200%−100%)*50%+100%=150%.

In the second example (B and W coexist), if PV is not adjusted, CWB=(200%−100%)* 50%+100%=150%, the CWB being equal to that in the first example (R and W coexist); if PV is adjusted using the adjustment factor 0.5, CWB=(100%−100%)*50%+100%=100%, the CWB being equal to that in the third example (W without RGB) calculated as follows.

In the third example (W without RGB), CWB=(100%−100%)*50%+100%=100%.

In one or more embodiments, the processing module 102 (and/or the brightness control member 106) may determine the CWB according to the following nonlinear formula:

CWB =(2−2*IBL)*RWB+(2*IBL−BB)*[(RWB−BB)*WBCP+BB]=[2−(doubled IBL)]*RWB+[(doubled IBL)−BB]*(first calculated brightness value)=(first adjustment coefficient)*RWB +(second adjustment coefficient)*(first calculated brightness value).

The nonlinear formula may further include the effect of the IBL on the CWB.

In one or more embodiments, the IBL may be limited to a range of 25% to 100%, which may result in a SV that is in a range of 200% to 50%. The 25% lower bound limit on the IBL may result in a 200% upper bound limit on SV, which may enable limiting the extent to which input data values (IDV) arc scaled. Excessively large scale values may cause implementation difficulties.

In the first example (R and W coexist), CWB=(2−2*IBL)*RWB+(2*IBL−BB)*150%=(2−2*100%)*200%+(2*100%−100%)*150%=150%.

In the second example (B and W coexist), if PV is not adjusted, CWB=(2−2*IBL)* RWB+(2*IBL−BB)*150%=(2−2*100%)*200%+(2*100%−100%)*150%=150%, the CWB being equal to that in the first example (R and W coexist); if PV is adjusted using the adjustment factor 0.5, CWB=(2−2*IBL)*RWB+(2*IBL−BB)*100%=(2−2*50%)* 100%+(2*50%−100%)*100%=100%, the CWB being equal to that in the third example (W without RGB) calculated as follows.

In the third example (W without RGB), CWB=(2−2*IBL)*RWB+(2*IBL−BB)*100%=(2−2*50%)*100%+(2*50%−100%)*100%=100%.

The nonlinear formula and the previously discussed linear formula may produce same CWB values as illustrated in the examples. Nevertheless, the nonlinear formula may produce CWB values that are different from CWB values produced by the linear formula.

In one or more embodiments, the processing module 102 (and/or the brightness control member 106) may determine the CWB according to the following hybrid formula:

CWB=N*(2−2*IBL)*RWB+[1−N*(2−2*IBL)]*[(RWB−BB)*WBCP+BB]=(third adjustment coefficient)*(first adjustment coefficient)*RWB+[1−(third adjustment coefficient)*(first adjustment coefficient)]*(first calculated brightness value)=(third adjustment coefficient)*(first adjustment coefficient)*RWB+(fourth adjustment coefficient)*(first calculated brightness value).

The hybrid formula may provide an intermediate CWB trajectory between the CWB trajectories provided by the previously discussed linear formula and nonlinear formula according to the blending value N, or the third adjustment coefficient, which may be in a range of 0 to 100%.

In step 218, the processing module 102 (and/or the modification member 136 or multiplier 136) may determine a modified scale value (MSV) using the CWB and the SV according to, for example, the formula:

MSV=CWB*SV.

In the first example (R and W coexist), MSV=150%*50%=75%.

In the second example (B and W coexist), if PV is not adjusted, MSV=150%*50%=75%, the MSV being equal to that in the first example (R and W coexist); if PV is adjusted using the adjustment factor 0.5, MSV=100%*100%=100%, the MSV being equal to that in the third example (W without RGB) calculated as follows.

In the third example (W without RGB), MSV=100%*100%=100%.

In step 220, the processing module 102 (and/or the scale value damper 108) may determine a damped scale value (DSV) using the current modified scale value (MSV), a modified scale value for the previous frame (MSVP), and a cap parameter (CAP) according to, for example, the following formula:

DSV=MSVP+Min(CAP, MSV−MSVP).

The CAP may limit the rate of change of the MSV from frame to frame, thereby advantageously preventing dramatic change in brightness adjustment. The CAP may be a constant or may be a dependent variable depending on some portion of the difference between the MSV and the MSVP. In order to avoid substantially affecting normal operation, the CAP may also be made to grow (become exceedingly large and ineffective) as the RWB (requested white brightness) approaches 100%, which may signal normal scale value operation and may signal that brightness reduction is not performed.

In one or more embodiments, in order to affect scale value transition, dampening may be implemented on one or more of the CWB, the RWB, and other inputs to the brightness control member 106.

In one or more embodiments, the processing module 102 may not include the scale value damper 108, and step 220 may not be implemented.

In step 222, the processing module 102 (and/or the data scaler 110) may determine LCD gray level signal values (GLSV) using the input image data values (IDV) in the current frame and the DSV (or the MSV if damping is not implemented).

In one or more embodiment, color shifting or biasing may not be implemented in step 222, and the processing module 102 (and/or the scale value damper 108) may determine the GLSV according to, for example, the formula:

GLSV=IDV*DSV, or GLSV=IDV*MSV if damping is not implemented.

In the first example (R and W coexist), assuming damping is not implemented, the GLSV may include (200%, 0, 0, 0)*75%=(150%, 0, 0, 0) for the R component and (100%, 100%, 100%, and 100%)*75%=(75%, 75%, 75%, 75%) for the W component.

In the second example (B and W coexist), assuming damping is not implemented, if PV is not adjusted, the GLSV may include (0, 0, 150%, 0) for the B component and (75%, 75%, 75%, 75%) for the W component; if PV is adjusted using the adjustment factor 0.5, the GLSV may include (0, 0, 200%, 0) for the B component and (100%, 100%, 100%, 100%) for the W component.

In the third example (W without RGB), assuming damping is not implemented, the GLSV may include (100%, 100%, 100%, 100%) for the W component.

In one or more embodiment, color shifting or biasing may be implemented in step 222, and the processing module 102 (and/or the data scaler 110) may include a set of hue-dependent bias factors, such as one or more of an R-associatcd bias factor 112, a G-associatcd bias factor 114, a B-associated bias factor 116, and a W-associated bias factor 118. Additionally or alternatively, the processing module 102 (and/or the data scaler 110) may include one or more bias factors associated with one or more other colors. the processing module 102 (and/or the data scaler 110) may determine the GLSV according to the formula:

GLSV=IDV*DSV*(hue-dependent bias factor), or GLSV=IDV*MSV*(hue-dependent bias factor) if damping is not implemented.

In one or more embodiments, the processing module 102 (and/or the data scaler 110) may shift a white component in the direction of blue as the brightness is reduced. Advantageously, the appearance of yellow colors may be enhanced.

In one or more embodiments, the shifting or biasing feature may decouple the scale value for the blue data channel (which may be associated with lower undesirable simultaneous contract effects) from the MSV (modified scale value) associated with the red and green data channels (which may be associated with higher undesirable simultaneous contract effects). For example, the B-associated bias factor 116 may be greater than 100% to counter the brightness reduction introduced by the MSV, while the R-associated bias factor 112 and the G-associated bias factor 114 may be 100% to comply with the brightness reduction. The processing module 102 may simply reduce the brightness associated with the red and green channels and may leave the blue scale value intact.

In step 224, the processing module 102 (and/or the data scaler 110) may provide LCD gray level signals that have the GLSV to the LCD display module 138.

In step 228, LCD display module 138 may display an image using the gray level signals that have the GLSV and using the light that is provided according to the BLSV. The user of the LCD device 100 may perceive GLSV*BLSV.

In the first example (R and W coexist), assuming damping and shifting arc not implemented, the user of the LCD device 100 may perceive (150%, 0, 0, 0)*100%=(150%, 0, 0, 0) from the R component and (75%, 75%, 75%, 75%)*100%=(75%, 75%, 75%, 75%) from the W component. Since the values (or brightness) of the W component has been reduced from (100%, 100%, 100%, 100%) to (75%, 75%, 75%, 75%), undesirable simultaneous contrast effects on the R component may be advantageously mitigated or obviated.

In the second example (B and W coexist), assuming damping and shifting are not implemented, if PV is not adjusted, the user of the LCD device 100 may perceive (0, 0, 150%, 0)*100%=(0, 0, 150%, 0) from the B component and (75%, 75%, 75%, 75%)*100%=(75%, 75%, 75%, 75%) from the W component. Since the values (or brightness) of the W component has been reduced from (100%, 100%, 100%, 100%) to (75%, 75%, 75%, 75%), undesirable simultaneous contrast effects on the R component may be advantageously mitigated or obviated. if PV is adjusted using the adjustment factor 0.5, the user of the LCD device 100 may perceive (0, 0, 200%, 0)*100%=(0, 0, 200%, 0) from the B component and (100%, 100%, 100%, 100%)*100%=(100%, 100%, 100%, 100%) from the W component. Given that undesirable simultaneous contrast effects on the B component may be insignificant or inconspicuous, high and satisfactory brightness may be advantageously provided for both the B component and the W component, and consistent brightness may be provided.

In the third example (W without RGB), assuming damping and shifting not implemented, the user may perceive (100%, 100%, 100%, 100%)*100%=(100%, 100%, 100%, 100%) from the W component with satisfactory and consistent brightness.

As can be appreciated from the foregoing, embodiments of the invention may properly scale down the brightness of image data when at least a saturated color and a least a desaturated color coexist in an image to be displayed, and embodiments of the invention may substantially maintain or maximize the brightness of image data when an image to be displayed includes one or more of desaturated colors but no saturated colors or includes one or more saturated colors but no desaturated colors. Advantageously, embodiments of the invention may provide the benefits of energy saving and/or brightness enhancement of RGBW devices while mitigating or obviating the undesirable simultaneous contrast effects that may be common in conventional RGBW devices.

According to one or more embodiments of the invention, brightness adjustment may be performed according to the hues of saturated colors in an image to be displayed. For example, if red and white coexist in the image, the brightness may be scaled down more, and if blue and white coexist in the image, the brightness may be scaled down less or may not be scaled down. Advantageously, unnecessary brightness reduction may be avoided or minimized, and substantially consistent and desirable user experience may be provided.

While this invention has been described in terms of several cmbodimcnts, there are alterations, permutations, and equivalents, which fall within the scope of this invention. It should also be noted that there are many alternative ways of implementing the methods and apparatuses of the present invention. Furthermore, embodiments of the present invention may find utility in other applications. The abstract section is provided herein for convenience and, due to word count limitation, is accordingly written for reading convenience and should not be employed to limit the scope of the claims. It is therefore intended that the following appended claims be interpreted as including all such alterations, permutations, and equivalents as fall within the true spirit and scope of the present invention.

What is claimed is:

1. A processing module for processing image data to provide a set of gray level signals to be used by a liquid crystal display module for displaying an image, the processing module comprising:

a scale value control member configured to determine a first scale value;

a brightness control member configured to determine a controlled brightness value using a requested brightness value, a brightness control parameter, and a baseline brightness value;

a modification member configured to determine a modified scale value using the first scale value and the controlled brightness value, the modified scale value pertaining to a current frame;

a scaler configured to generate the set of gray level signals using the image data and at least one of the modified scale value and a damped scale value, the damped scale value being determined using the modified scale value; and hardware circuitry configured to one or more tasks associated with at least one of the scale value control member, the brightness control member, the modification member, and the scaler.

2. The processing module of claim 1 further comprising a scale value damper configured to determine the damped scale value using the modified scale value, a previous-frame modified scale value that pertains to a previous frame, and a cap parameter.

3. The processing module of claim 1 further comprising an adjustment member configured to determine an adjusted backlight value using an internal backlight value and a brightness setting value, wherein the requested brightness value is determined using the adjusted backlight value and the baseline brightness value.

4. The processing module of claim 3 further comprising a survey member configured to determine a peak value based on a maximum value pertaining to the image data in a previous frame, wherein the first scale value and the internal backlight value are determined using the peak value.

5. The processing module of claim 4 wherein the survey member is further configured to determine the peak value according to a color associated with the maximum value.

6. The processing module of claim 1 wherein the brightness control member is configured for multiplying a difference between the requested brightness value and the baseline brightness value by the brightness control parameter to produce a first product, and wherein the brightness control member is further configured for adding the first product to the baseline brightness value to produce a first calculated brightness value.

7. The processing module of claim 6 wherein the brightness control member is further configured for providing the first calculated brightness value as the controlled brightness value.

8. The processing module of claim 6 wherein the brightness control member is further configured for doubling an internal backlight value to produce a doubled internal backlight value, wherein the internal backlight value is determined using a peak value pertaining to the image data, wherein the brightness control member is further configured for subtracting the doubled internal backlight value from 2 to produce a first adjustment coefficient, wherein the brightness control member is further configured for subtracting the baseline brightness value from the doubled internal backlight value to produce a second adjustment coefficient, and wherein the brightness control member is further configured for determining the controlled brightness value using the first adjustment coefficient, the requested brightness value, and the first calculated brightness value.

9. The processing module of claim 8 wherein the brightness control member is further configured for calculating the controlled brightness value by adding a product of the second adjustment coefficient and the first calculated brightness value to a product of the first adjustment coefficient and the requested brightness value.

10. The processing module of claim 8 wherein the brightness control member is further configured for subtracting a product of a third adjustment coefficient and the first adjustment coefficient from 1 to produce a fourth adjustment coefficient, wherein the brightness control member is further configured for calculating the controlled brightness value by adding a product of the fourth adjustment coefficient and the first calculated brightness value to a product of the third adjustment coefficient, the first adjustment coefficient, and the requested brightness value.

11. The processing module of claim 1 wherein the scaler is configured to generate the set of gray level signals further using a set of hue-dependent bias factors.

12. A liquid crystal display device comprising:

a scale value control member configured to determine a first scale value;

a brightness control member configured to determine a controlled brightness value using a requested brightness value, a brightness control parameter, and a baseline brightness value;

a modification member configured to determine a modified scale value using the first scale value and the controlled brightness value, the modified scale value pertaining to a current frame;

a scaler configured to generate a set of gray level signals using image data and at least one of the modified scale value and a damped scale value, the damped scale value being determined using at least the modified scale value;

a backlight module configured to provide light;

a liquid crystal display module configured to display an image using the set of gray level signals and the light; and hardware circuitry configured to perform one or more tasks associated with at least one of the scale value control member, the brightness control member, the modification member, the scaler, the backlight module, and the liquid crystal display module.

13. A method for processing image data to provide a set of gray level signals to be used by a liquid crystal display module for displaying an image, the method being implemented using hardware circuitry, the method comprising:

determining a first scale value using the hardware circuitry;

determining a controlled brightness value using a requested brightness value, a brightness control parameter, a baseline brightness value, and the hardware circuitry;

determining a modified scale value using the first scale value, the controlled brightness value, and the hardware circuitry, the modified scale value pertaining to a current frame; and generating the set of gray level signals using the image data, at least one of the modified scale value and a damped scale value, and the hardware circuitry, the damped scale value being determined using at least the modified scale value.

14. The method of claim 13 further comprising determining the damped scale value using the modified scale value, a previous-frame modified scale value that pertains to a previous frame, and a cap parameter.

15. The method of claim 13 further comprising:

determining an adjusted backlight value using an internal backlight value and a brightness setting value; and determining the requested brightness value using the adjusted backlight value and the baseline brightness value.

16. The method of claim 15 further comprising:

determining a peak value based on a maximum value pertaining to the image data in a previous frame; and determining the first scale value and the internal backlight value using the peak value.

17. The method of claim 16 further comprising determining the peak value according to a color associated with the maximum value.

18. The method of claim 13 further comprising:

multiplying a difference between the requested brightness value and the baseline brightness value by the brightness control parameter to produce a first product; and adding the first product to the baseline brightness value to produce a first calculated brightness value.

19. The method of claim 18 further comprising providing the first calculated brightness value as the controlled brightness value.

20. The method of claim 18 further comprising:

doubling an internal backlight value to produce a doubled internal backlight value;

determining the internal backlight value using a peak value pertaining to the image data;

subtracting the doubled internal backlight value from 2 to produce a first adjustment coefficient;

subtracting the baseline brightness value from the doubled internal backlight value to produce a second adjustment coefficient; and determining the controlled brightness value using the first adjustment coefficient, the requested brightness value, and the first calculated brightness value.

* * * * *